US010667580B2

(12) United States Patent
Kovach et al.

(10) Patent No.: US 10,667,580 B2
(45) Date of Patent: Jun. 2, 2020

(54) LACE TIGHTENING MECHANISM AND PARAMETER DETECTOR DISPOSED THEREIN

(71) Applicant: Under Armour, Inc., Baltimore, MD (US)

(72) Inventors: F. Grant Kovach, Baltimore, MD (US); Jeffrey Allen, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 61 days.

(21) Appl. No.: 15/730,095

(22) Filed: Oct. 11, 2017

(65) Prior Publication Data

US 2019/0104808 A1 Apr. 11, 2019

(51) Int. Cl.
*A43C 11/16* (2006.01)
*A43B 3/00* (2006.01)

(52) U.S. Cl.
CPC ..... *A43C 11/165* (2013.01); *A43B 3/0005* (2013.01)

(58) Field of Classification Search
CPC ..... A43C 11/165; A43B 3/0005
See application file for complete search history.

(56) References Cited

U.S. PATENT DOCUMENTS

| | | | | |
|---|---|---|---|---|
| 7,404,263 | B2 * | 7/2008 | Guzman | A43B 3/0005 36/128 |
| 8,061,061 | B1 * | 11/2011 | Rivas | A43B 3/001 24/68 SK |
| 9,578,926 | B2 * | 2/2017 | Alt | A43C 11/20 |
| 9,861,164 | B2 * | 1/2018 | Beers | A43B 3/0005 |
| 2004/0221433 | A1 * | 11/2004 | Wolfberg | A43B 3/0005 24/712.5 |
| 2014/0082963 | A1 * | 3/2014 | Beers | A43C 11/00 36/83 |
| 2016/0157561 | A1 * | 6/2016 | Schum | A43B 3/0005 242/390 |
| 2018/0056104 | A1 * | 3/2018 | Cromie | A63B 21/4007 |
| 2018/0289110 | A1 * | 10/2018 | Bock | A43C 11/165 |
| 2018/0343977 | A1 * | 12/2018 | Riccomini | A43C 11/165 |

* cited by examiner

*Primary Examiner* — Victor D Batson
*Assistant Examiner* — Matthew J Sullivan

(57) ABSTRACT

A tightening mechanism is provided for use with a lace that is laced through an opening of an article. The tightening mechanism includes: a tightening mechanism base configured to attach to the article; a tightening mechanism housing disposed on the tightening mechanism base; a tightening mechanism rotatable reel positioned within the tightening mechanism housing and that can take up the lace; and a parameter detector operable to detect a parameter associated with the article and to generate parameter data of the detected parameter.

20 Claims, 7 Drawing Sheets

LACE TIGHTENING MECHANISM AND PARAMETER DETECTOR DISPOSED THEREIN

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

The present invention generally relates to tracking the activity of a user.

There exists a need for a device that incorporates a parameter detector integral with a shoe, yet in a location other than the sole of a shoe.

BRIEF SUMMARY OF THE DRAWINGS

The accompanying drawings, which are incorporated in and form a part of the specification, illustrate example embodiments and, together with the description, serve to explain the principles of the invention. In the drawings.

All Figures © Under Armour, Inc. 2017. All rights reserved.

DETAILED DESCRIPTION

Overview

A tightening mechanism is provided for use with a lace that is laced through an opening of an article. The tightening mechanism includes: a tightening mechanism base configured to attach to the article; a tightening mechanism housing disposed on the tightening mechanism base; a tightening mechanism rotatable reel positioned within the tightening mechanism housing and that can take up the lace; and a parameter detector operable to detect a parameter associated with the article and to generate parameter data of the detected parameter.

These and other aspects of the disclosure shall become apparent when considered in light of the disclosure provided herein.

Example Embodiments

One of the recent trends in fitness is using a wearable device to record data related to the activity a user is performing. The data can be downloaded directly to a receiving device, which can be a desktop, laptop or tablet computer, mobile phone, or other smart device, and the user can refer to the downloaded data to track his progress. A conventional wearable device may incorporate various sensors to quantify activity and movement. Non-limiting examples of such sensors include temperature sensors, pressure sensors, water sensors, moisture sensors, saline sensors, electric field sensors, current sensors, voltage sensors, impedance sensors, magnetic field sensors, accelerometers, altimeters, GPS sensors, magnetometers, optical sensors, and chemical sensors.

In many cases the wearable activity tracker is placed within a recess of the sole of a user's shoe. This can negatively impact the shoe design and the feel of the shoe when it is worn by the user. Additionally, changing a battery and/or replacing one or more parts of the activity tracker disposed internal to the shoe is further difficult if not impossible to manage. Therefore, there exists a need for an activity tracker that may be integrated with a shoe but is not located within the sole of a shoe.

Figure 1:
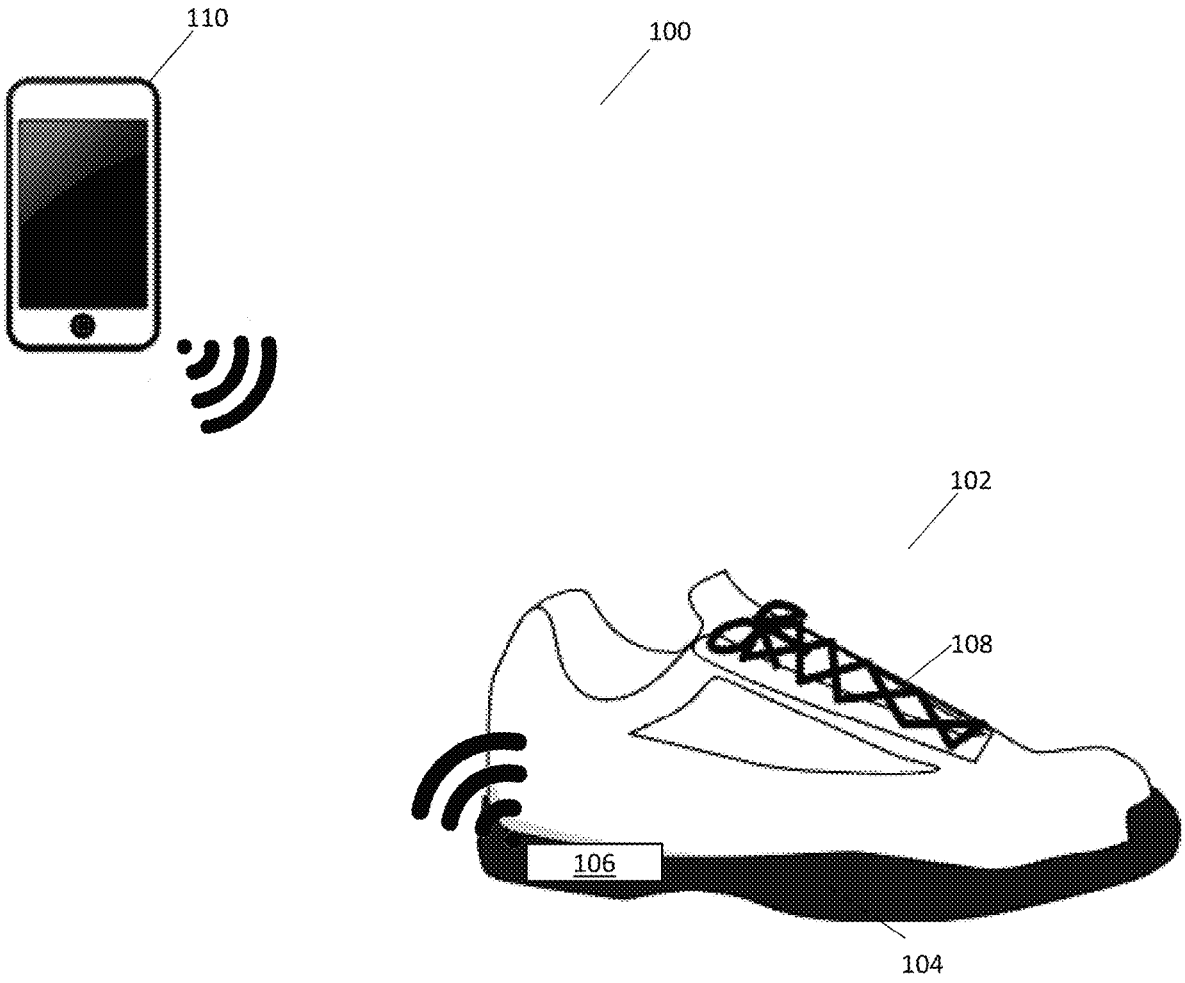
PRIOR ART FIG. 1
FIG. 1 illustrates a prior art activity tracking device and system.

FIG. 1 illustrates a prior art activity tracking system 100. As shown in the figure, system 100 includes a shoe 102 and a mobile device 110. Shoe 102 further includes a sole 104 and laces 108. A parameter detector 106 is disposed within sole 104.

Mobile device 110 may be any device or system that can communicate wirelessly via a cellular network or WiFi. Non-limiting examples of mobile device 110 include mobile phones, tablet computers, laptop computers, and any other portable device that can communicate over cellular or WiFi networks.

Parameter detector 106 may be any device or system that can detect parameters related to a user's activity. For example, parameter detector 106 may detect steps, acceleration, foot landing force, speed, calories burned, combinations thereof, and any other parameters related to the activity of a user. Parameter detector 106 also transmits data related to the parameters detected to mobile device 110 via cellular or WiFi network.

Parameter detector 106 is disposed within sole 104 of shoe 102, and can be activated when a user puts on shoe 104 and the force of the user's foot is detected by parameter detector 106. Parameter detector 106 may also be activated by mobile device 110. A user may open an activity tracking application on mobile device 110 and press a button to activate parameter detector 106. Mobile device 110 would then send a wake up signal to parameter detector 106 via cellular or WiFi network, and when parameter detector 106 receives the signal parameter detector 106 wakes up and attempts to detect activity of the user.

Sole 104 must be constructed to provide space for parameter detector 106, which can cause complications in manufacturing. To create sole 104 such that it has a similar cushioning as a sole that does not include a parameter detector, sole 104 may need to be thicker to account for the presence of parameter detector 106. Or, if sole 104 is the same thickness as a sole of a shoe that does not contain a parameter detector, sole 104 may not be as comfortable for the user.

Including a parameter detector on a shoe that is not within the sole may require a non-integral device be attached to the shoe in various locations. Non-integral parameter detectors may be hooked on to laces 108, but problems exist with those parameter detectors falling off or being an annoyance to the user.

Figure 2A:
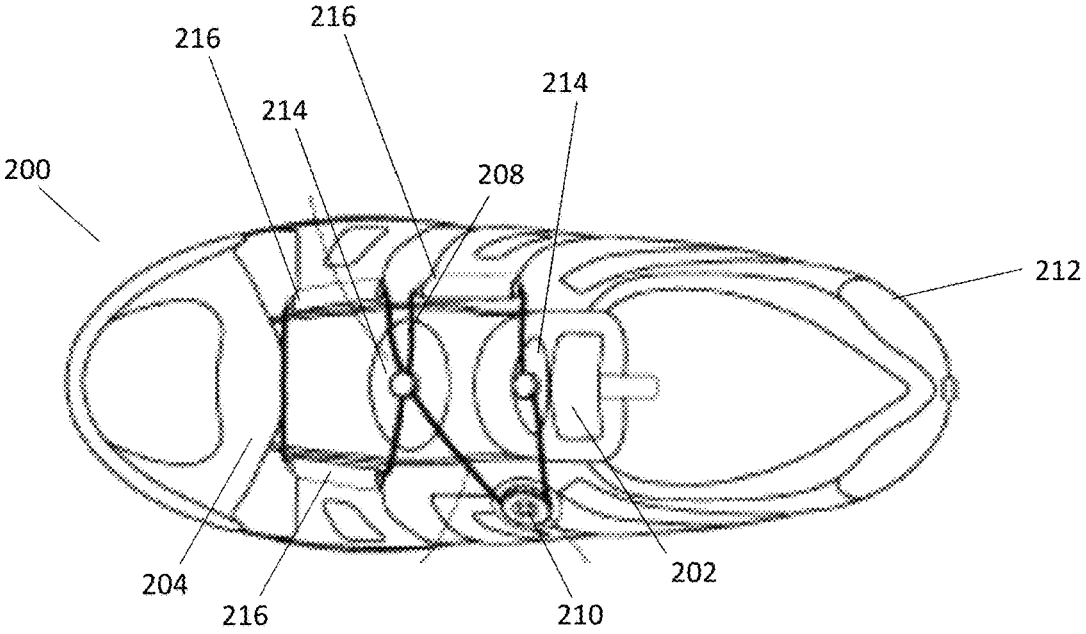
PRIOR ART FIG. 2A
FIG. 2A illustrates a top view of a prior art shoe lace tightening system.
Figure 2B:
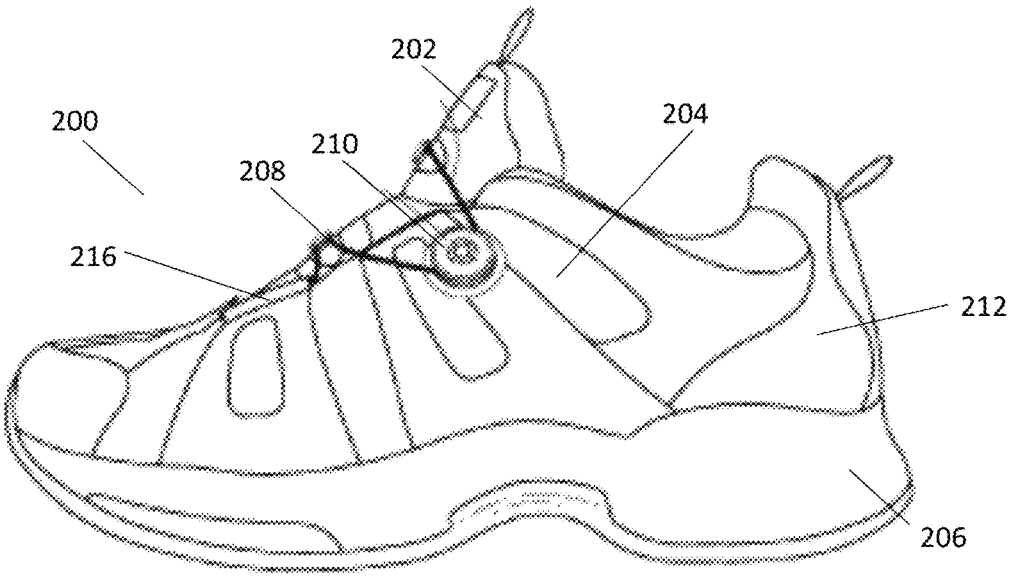
PRIOR ART FIG. 2B
FIG. 2B illustrates a side view of the shoe lace tightening system of FIG. 2A.

FIGS. 2A-2B illustrate a prior art shoe lace tightening system. FIG. 2A illustrates a top view of a prior art shoe lace tightening system 200, whereas FIG. 2B illustrates a side view of the shoe lace tightening system 200.

As shown in the figures, system 200 includes a shoe 212. Shoe 212 further includes a tongue 202, a body 204, a sole 206, a lace 208, lace stabilizers 214, lace guides 216, and a tightening mechanism 210.

Tongue 202, body 204, and sole 206 are conventional parts of shoe 212. Body 204 is connected to sole 206, and tongue 202 is connected to body 204.

Tightening mechanism 210 is disposed on body 204. Tightening mechanism 210 may be any device or system that can be rotated to tighten or loosen a string or cable. Tightening mechanism 210 includes other internal components that interact with laces 208, and those components will be further described with reference to FIGS. 3A-3C.

Lace stabilizers 214 are disposed on tongue 202. Lace stabilizers 214 further include holes through which lace 208 can pass. Lace 208 may be a conventional woven lace, but lace 208 may also include other materials that are more rigid and do not deform in response to a force the same way a conventional woven lace does.

Lace guides 216 are disposed on body 204 in close proximity to tongue 202 and cannot be removed from body 204. Lace guides 216 include a hole through which lace 208 can pass.

To assemble lace 208 to shoe 212, one end of the lace 208 is first connected to tightening mechanism 210. The free end of lace 208 is then passed through lace stabilizers 214 and lace guides 216 to create the crisscross pattern shown in FIG. 2A. The free end of lace 208 is then connected to tightening mechanism 210.

In operation, a user will insert his foot into shoe 212. Then, instead of tightening lace 208 by tying two loose ends together, the user rotates tightening mechanism 210 in one direction, which tightens lace 208, until the user is comfortable that lace 208 is the appropriate tightness. To loosen lace 208 before removing shoe 212, the user rotates tightening mechanism 210 in the opposite direction. The tightening and loosening of mechanism will now be described in more detail with reference to FIGS. 3A-3C.

Figure 3A:
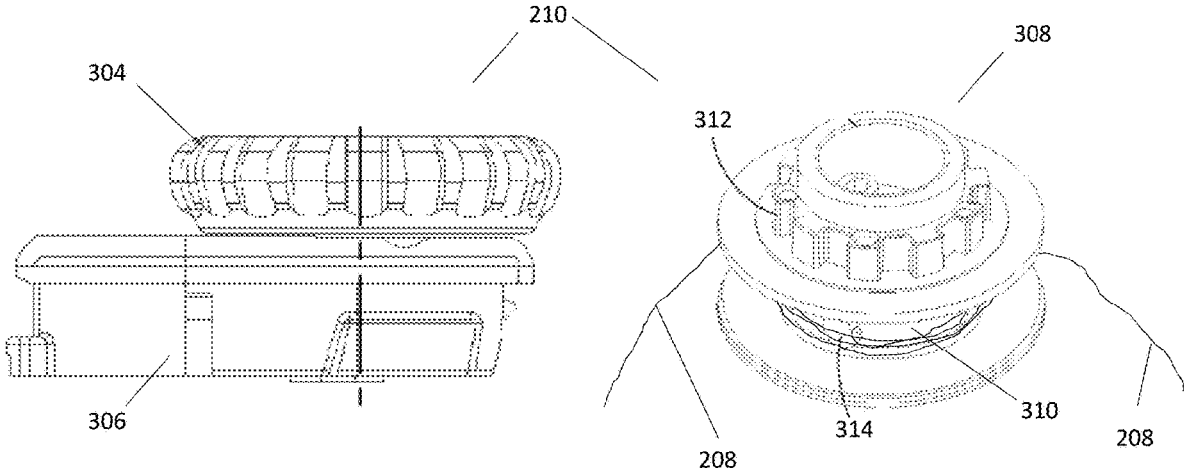
PRIOR ART FIG. 3A
FIG. 3A illustrates a side view and an internal view of the prior art lace tightening mechanism in a first state of operation.
Figure 3B:
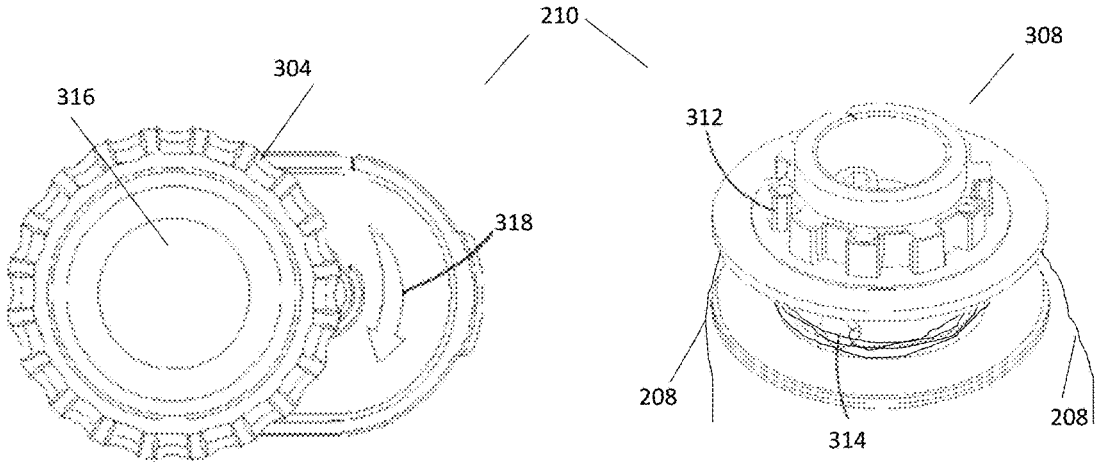
PRIOR ART FIG. 3B
FIG. 3B illustrates a side view and an internal view of the prior art lace tightening mechanism in a second state of operation.
Figure 3C:
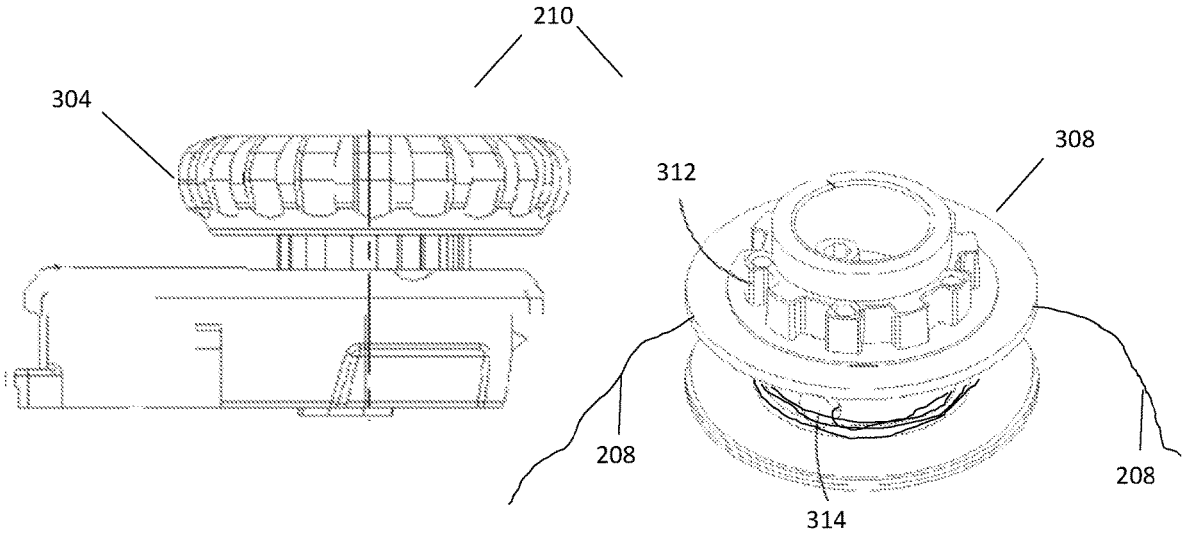
PRIOR ART FIG. 3C
FIG. 3C illustrates a side view and an internal view of the prior art lace tightening mechanism in a third state of operation.

FIGS. 3A-3C illustrate a prior art tightening mechanism in three states of operation.

As shown in the figures, tightening system 210 includes a knob 304, a housing 306, a rotatable reel 308, a circular post 310, teeth 312, a lace hole 314, and a cap 316.

Rotatable reel 308 is disposed within tightening system 210 such that rotatable reel 308 is located within housing 306, and knob 304 interacts with teeth 312. When knob 304 is rotated in one direction, knob 304 engages teeth 312 and causes rotatable reel 308 to rotate in the same direction as knob 304.

To assemble lace 208 to rotatable reel 308, a first end of lace 208 is attached to circular post 310. In some embodiments, a first end of lace 208 is threaded through lace hole 314 before being attached to circular post 310, but in other embodiments lace 208 is attached to circular post 310 without first being threaded through lace hole 314.

After the first end of lace 208 is attached to rotatable reel 308, the second end of lace 208 is threaded through lace stabilizers 214 and lace guides 216 as shown in FIGS. 2A-2B. The second end of lace 208 is then attached to circular post 310 in a manner similar to that of the first end of lace 208. Thus, when rotatable reel 308 is rotated in one direction lace 208 is wound tighter around circular post 310, and when rotatable reel 308 is rotated in the other direction lace 208 is loosened from circular post 310.

In operation, when a user slides his foot into shoe 212, tightening mechanism 210 is in the position shown in FIG. 3A, and knob 304 is engaged with teeth 312. To tighten lace 208, the user turns knob 304 in the direction of arrow 318 as shown in FIG. 3B. When the user turns knob 304, rotatable reel 308 turns as well, and as rotatable reel 308 turns, lace 208 wraps around circular post 310, causing lace 208 to tighten around the user's foot. When the user feels lace 208 is tight enough, he stops turning knob 304, and the tension of lace 208 is maintained by tightening mechanism 210.

When the user wants to loosen lace 208 to remove shoe 212, he may choose to turn knob 308 in the opposite direction to turn rotatable wheel 308 in the opposite direction, thus loosening lace 208 as shown in FIG. 3C. In other embodiments, the user may first pull knob 304 away from shoe 212 to disengage knob 304 from teeth 312. With knob 304 not engaged with teeth 312, the user can pull tongue 202 upwards to loosen lace 208, or the user can pull directly on lace 208 as he would on conventional laces. The user can then remove his foot from shoe 212.

In accordance with aspects of the present invention, a parameter detector may be disposed within a lace tightening mechanism. In this manner, activity of the user may be monitored without having the parameter detector in the sole of the shoe. Therefore, the comfort of the user of the shoe is not compromised with a pod in the sole of the shoe. Further, the manufacturing of the shoe itself is streamlined as a space for a pod is not required to be created in the sole of the shoe.

Aspects of the present invention will now be discussed with reference to FIGS. 4-6.

Figure 4A:
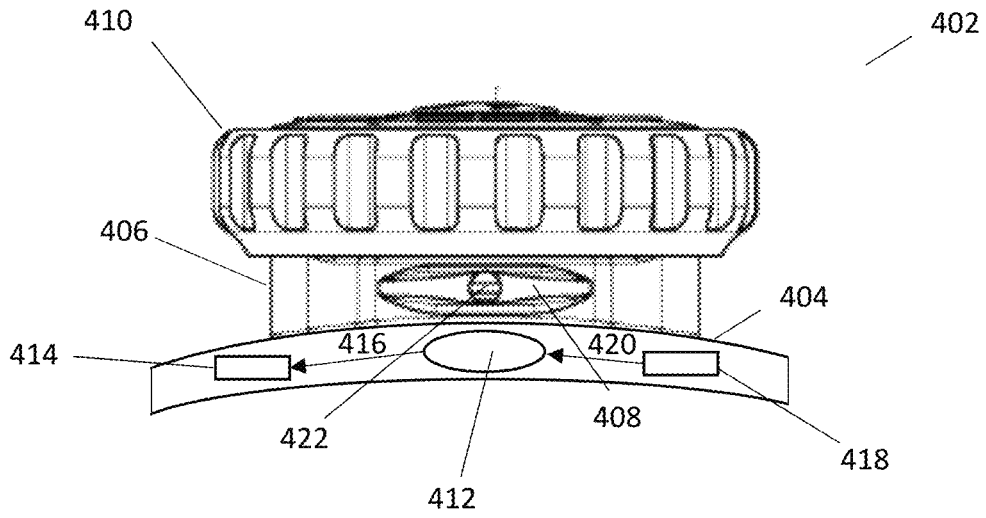
FIG. 4A illustrates an example embodiment of a tightening mechanism in accordance with aspects of the present invention.
Figure 4B:
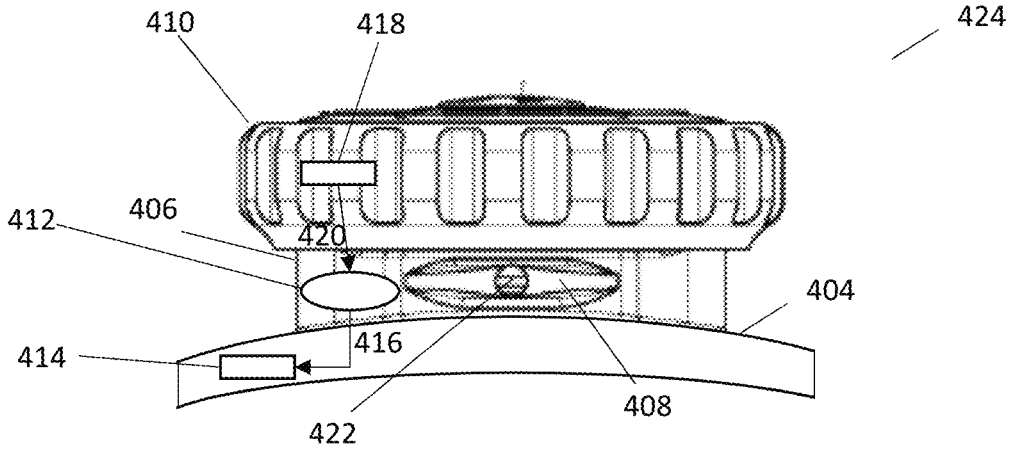
FIG. 4B illustrates another example embodiment of a tightening mechanism in accordance with aspects of the present invention.

FIGS. 4A-4B illustrate two example embodiments of a tightening mechanism in accordance with aspects of the present invention.

As shown in the figures, each of tightening mechanisms 402 and 424 include a base 404, a housing 406, a rotatable reel 408, a knob 410, a parameter detector 412, a transmitter 414, a power source 418, and a lace hole 422.

Base 404 is configured to be attached to a shoe and provide a platform on which all other components of tightening mechanisms 402 and 424 are mounted. Base 404 may be attached to any location on a shoe that provides for a secure attachment and for which a lace may be engaged. For example, and with reference to FIGS. 2A-2B, in some embodiments base 404 may be attached to tongue 202, and in other embodiments base 404 may be attached to body 204.

Housing 406 is connected to base 404 and provides a space in which rotatable reel 408 is disposed. The top of housing 406 is covered by knob 410.

Rotatable reel 408 is rotatably attached to base 404 such that rotatable reel 408 can rotate relative to base 404. Rotatable reel 408 is also disposed within housing 406 such that rotatable reel 408 can rotate relative to housing 406. Rotatable reel 408 is substantially similar to rotatable reel 308 described with reference to FIGS. 3A-3C. Rotatable reel 408 further includes lace hole 422, which is substantially similar to lace hole 314 described with reference to FIGS. 3A-3C.

Knob 410 surrounds housing 406 and interacts with rotatable reel 408 such that when knob 410 is rotated, rotatable reel 408 also rotates.

In a first example embodiment, with reference to FIG. 4A, base 404 further includes a power source 418, a parameter detector 412, and a transmitter 414.

Power source 418 is in electrical communication with parameter detector 412 via communication channel 420. Power source 418 may be any type of power source that can provide power to parameter detector 412 and transmitter 414. Non-limiting examples of power source 418 include button cell batteries and hearing aid batteries, though other small power sources may be used. In some embodiments, power source 418 is embedded in base 404. In other embodiments, base 404 may include a removable cover to provide a user access to power source 418 in case power source 418 needs to be replaced.

Parameter detector 412 is in communication with transmitter 414 via communication channel 416 and with power source 418 via communication channel 420. Parameter detector 412 is configured to detect parameters associated with a user's activity and provide the detected parameters to transmitter 414. Non-limiting examples of parameter detector 412 include accelerometers, magnetometers, pressure sensors, electric field detectors, current detectors, voltage detectors, RF receivers and combinations thereof. Non-limiting examples of some parameters that may be detected by parameter detector 412 include speed, acceleration, distance, force, balance, stamina and combinations thereof.

Transmitter 414 is in communication with parameter detector 412 via communication channel 416. Transmitter 414 may be any device or system configured to receive detected parameters from parameter detector 412 and send the data associated with the detected parameters to a device over a cellular or WiFi network.

In this example embodiment, power source 418, parameter detector 412, and transmitter 414 are shown as independent components. However, in some embodiments at least two of power source 418, parameter detector 412, and transmitter 414 may be combined as a unitary device.

Furthermore, power source 418, parameter detector 412, and transmitter 414 may be included as independent components or as a unitary device disposed on a flexible printed circuit board or a composite material similar to FR4, a material including woven fiberglass cloth with an epoxy resin binder.

In addition, the location of power source 418, parameter detector 412, and transmitter 414 may be different in other embodiments. For example, in another example embodiment, as shown in FIG. 4B, power source 418 is located within knob 410 and parameter detector 412 is located within housing 406. Each of power source 418, parameter detector 412, and transmitter 414 may be disposed in various locations on tightening devices 402 and 424 and should not be limited to those embodiments shown in FIGS. 4A-4B.

Also, some embodiments may include more than one parameter detector. Some parameter detectors may be very good at detecting aspects such as speed, distance, and acceleration, but may not be very good at detecting other aspects such as heart rate or foot strike force. In those instances it may be beneficial for tightening mechanisms 402 and 424 to include multiple parameter detectors to more accurately detect the desired parameters. Any additional parameter detectors included within tightening mechanisms 402 and 424 will be in communication with power source 418 and transmitter 414.

A specific non-limiting embodiment of locating a power source within a tightening mechanism will now be described in greater detail with reference to FIG. 5.

Figure 5:
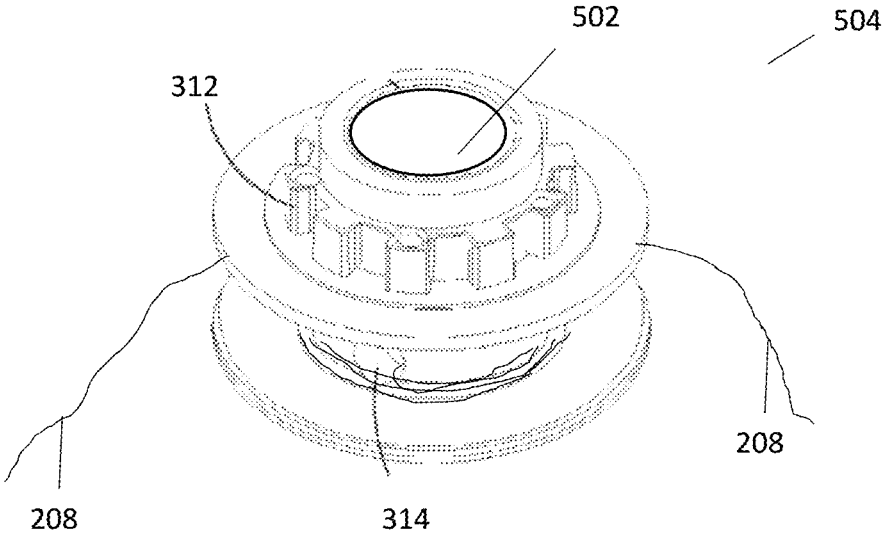
FIG. 5 illustrates an example rotatable reel in accordance with aspects of the present invention.

FIG. 5 illustrates a rotatable reel according to aspects of the present invention.

As shown in the figure, rotatable reel 504 includes power source 502.

Rotatable reel 504 is substantially similar to rotatable reel 308 and rotatable reel 408 with the exception of the addition of power source 502. Because rotatable reel 504 is generally circular or cylindrical shaped, power source 502 is implemented as a circular button cell is implemented on rotatable reel 504 to save space in the overall design.

The operation of tightening mechanism 402 will now be described with additional reference to FIG. 6.

Figure 6:
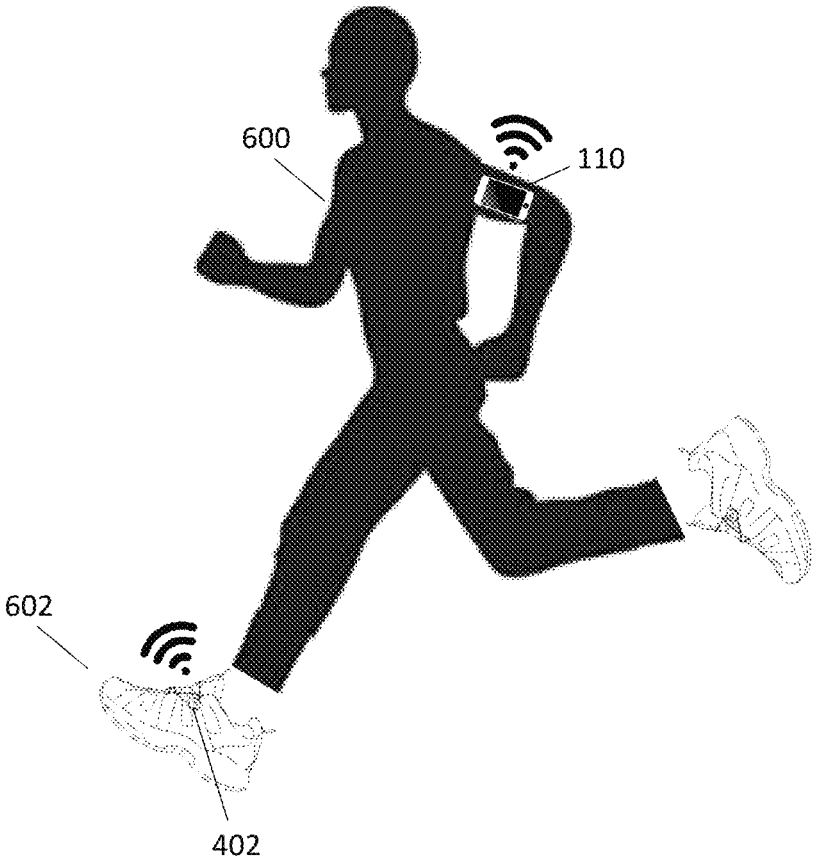
FIG. 6 illustrates an example tightening mechanism in communication with a mobile device in accordance with aspects of the present invention.

FIG. 6 illustrates a tightening mechanism in communication with a mobile device according to aspects of the present invention.

As shown in the figure, a user 600 is running and has mobile device 110 strapped to his arm. User 600 is wearing a shoe 602 that includes tightening mechanism 402. For purposes of discussion, user 600 desires to go for a run and would like to track multiple aspects of his activity, including the distance he runs, the speed at which he runs, and the force at which his feet strike the ground.

In this example embodiment, tightening mechanism 402 includes two parameter detectors to optimize the detection of both speed and foot strike force.

To get ready for his run, user 600 puts his feet in his shoes, including shoe 602. User 600 will tighten the lace on shoe 602 in a manner substantially similar to the method discussed with reference to FIGS. 2A-2B and FIGS. 3A-3C. After the lace on shoe 602 is tightened, user 600 activates the parameter detectors located within tightening mechanism 402. In some embodiments, the parameter detectors may be activated by tightening the lace so the user does not have to purposely activate the parameter detectors. In other embodiments, the user may have to press down on the top of tightening mechanism 402 to activate the parameter detectors. In yet other embodiments, the user may activate the parameter detectors by sending a wake up signal from an application on mobile device 100. The wake up signal would be received by tightening mechanism 402, and the parameter detectors would wake up and begin detecting the performance of user 600. User 600 then performs his run.

As user 600 is running, walking, or otherwise working out wearing the shoe, the parameter detectors are detecting the desired parameters of user 600. As the parameters are being detected, the parameter detectors provide the parameter data transmitter 414, and transmitter 414 provides the parameter data to mobile device 110. In an alternate embodiment, user 600 may not bring mobile device 110 with him on his run, so the parameter data would not be transmitted to mobile device 110 until tightening mechanism 402 was in range of mobile device 110.

After his run, walk, or workout, user 600 loosens the lace on shoe 602 in a manner substantially similar to the method discussed with reference to FIGS. 2A-2B and FIGS. 3A-3C. After the lace is loosened, user 600 may remove shoe 602. In some embodiments, tightening mechanism may go into sleep mode after a pre-set amount of time during which no parameters are detected. In other embodiments, tightening mechanism may go into sleep mode after a pre-set amount of time after the lace on shoe 602 is loosened.

The above discussed non-limiting example embodiments are drawn to a tightening mechanism with a parameter detecting system for tightening a lace of a shoe. It should be noted that a tightening mechanism with a parameter detecting system in accordance with aspects of the present invention may be used with any article that uses a lace that may be tightened, non-limiting examples of which include jackets, bags, tents, pants, etc.

The apparatus and methods described above may be utilized in the herein-described practical applications.

A tightening mechanism may be provided for use with a lace that is laced through an opening of an article. The tightening mechanism includes a base configured to attach to the article, a housing disposed on the base, a rotatable reel positioned within the housing and operable to take up the lace; and a parameter detector operable to detect a parameter associated with the article and to generate parameter data of the detected parameter. The parameter detector may comprise one or more of: an accelerometer, a magnetometer, a pressure sensor, an electric field detector, a current detector, a voltage detector, a temperature sensor, a heart rate monitor, and an RF receiver. The tightening mechanism may also include a transmitter configured to transmit the parameter data; and the parameter detector may be disposed at either the housing or the base.

A system for securing a cable which traverses an opening of an article is also enabled. The system includes a base comprising at least one mechanism configured to enable it to be affixed to the article, a cap comprising at least one mechanism configured to it to be secured to the base, a rotatable wheel, and one or more electronic components configured to detect at least one parameter associated with a use of the article by a wearer thereof.

The rotatable wheel, when rotated in a first direction, spools the cable thereby decreasing an overall length of the cable available to traverse the opening; and, when rotated in a second direction, unspools the cable thereby increasing the overall length of the cable available to traverse the opening. The rotatable wheel is rotated in the first or second direction via rotation of the cap and may be housed in either the base or the cap. In one configuration, the rotatable wheel comprises a circular post around which a cable is wound.

The electronic components may be housed in the base, the cap, or the interior of the circular post of the rotatable wheel. Exemplary electronic components include e.g, an accelerometer, a magnetometer, a pressure sensor, an electric field detector, a current detector, a voltage detector, an RF receiver and combinations thereof. Additionally, the electronic components may be disposed on a flexible printed circuit board (PCB) or FR4. It is noted that when the electronic components are house in a rotatable component (such as the cap or the interior of the circular post of the rotatable wheel), they may be further configured to monitor a number and direction of rotations applied thereto. In this manner, once rotation is completed (as indicated by a period of ceased rotation, for example 3 seconds), the electronic components are able to utilize the known number and direction of rotations to re-calibrate their orientation. Once re-calibrated, normal parameter detection may resume or begin.

The system may further include a power source to provide power to the electronic components; the power source may be housed in the base, the cap, or the interior of the circular post of the rotatable wheel. The power source may comprise, for example, a removable battery which is accessible via removal of the cap from the base.

Additionally, the system may include a transceiver apparatus to transmit data relating to the detected parameter associated with the use of the article by the wearer.

In another exemplary application of the herein-described apparatus and methods, an electronically-enabled tightening mechanism for securing a cable which traverses an opening of an article is provided. As discussed above, the mechanism includes a base affixed to the article, a cap secured to the base, a rotatable wheel, one or more electronic components, and a power source.

The rotatable wheel increases or decreases an overall length of the cable available to traverse the opening based on a direction of rotation thereof, the rotation being performed via rotation of the cap. In one exemplary embodiment, the rotatable wheel is housed in either the base or the cap and comprises a circular post around which the cable is wound.

The electronic components detect and transmit at least one parameter associated with a use of the article by a wearer thereof and can be housed in either the cap or the interior of the circular post of the rotatable wheel. Exemplary electronic components include e.g., an accelerometer, a magnetometer, a pressure sensor, an electric field detector, a current detector, a voltage detector, an RF receiver, and combinations thereof. Moreover, the detected parameter may include e.g., speed, acceleration, distance, orientation, change in direction, force, pressure, heart rate, and combinations thereof. In order to provide the aforementioned capabilities, the electronic components are disposed on at least one of a flexible printed circuit board (PCB) or FR4. It is further noted, as discussed above, that when the electronic components are housed in either the cap or the interior of the circular post of the rotatable wheel (i.e., rotatable components), they may be configured to monitor a number and direction of rotations applied thereto in order to re-calibrate orientation prior to detection of the at least one parameter.

The power source provides power to the electronic components and may be housed in the base, cap, or interior of the circular post of the rotatable wheel. In one specific implementation, the power source comprises a removable battery which is accessible via removal of the cap from the base.

In summary, the tightening mechanism of the present invention provides a user the ability to have an activity tracking device on his shoe without having the activity tracking device disposed within the sole of the shoe. By including an activity tracking device on a lace tightening mechanism instead of the sole of the shoe, the comfort of the shoe is not compromised.

The herein described applications improve the functioning of the shoe and/or shoe pod by enabling the electronic components to be attached to the shoe at a more convenient and easily accessible location than within the sole. Shoes that are able to provide ease of use and access of electronic components as disclosed herein can operate to provide an overall better experience for a user.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

It will also be appreciated that the various ones of the foregoing aspects of the present disclosure, or any parts or functions thereof, may be implemented using hardware, software, firmware, tangible, and non-transitory computer readable or computer usable storage media having instructions stored thereon, or a combination thereof, and may be implemented in one or more computer systems.

It will be apparent to those skilled in the art that various modifications and variations can be made in the disclosed embodiments of the disclosed device and associated methods without departing from the spirit or scope of the disclosure. Thus, it is intended that the present disclosure covers the modifications and variations of the embodiments disclosed above provided that the modifications and variations come within the scope of any claims and their equivalents.

The foregoing description of various preferred embodiments have been presented for purposes of illustration and description. It is not intended to be exhaustive or to limit the invention to the precise forms disclosed, and obviously many modifications and variations are possible in light of the above teaching. The example embodiments, as described above, were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed as new and desired to be protected by Letters Patent of the United States is:

1. A tightening mechanism for use with a lace that is laced through an opening of an article, said tightening mechanism comprising:

a tightening mechanism base configured to attach to said article;

a tightening mechanism housing disposed on said tightening mechanism base;

a tightening mechanism rotatable reel positioned within said tightening mechanism housing and operable to take up said lace upon manual rotation thereof;

a parameter detector disposed substantially within the tightening mechanism housing operable to detect a parameter associated with an activity performed by a wearer of said article and to generate parameter data of said detected parameter for transmission to a mobile device; and at least one transceiver apparatus configured to transmit said detected parameter to said mobile device.

2. The tightening mechanism of claim 1, wherein said parameter detector comprises one or more of: an accelerometer, a magnetometer, a pressure sensor, an electric field detector, a current detector, a voltage detector, and an RF receiver.

3. A system for securing a cable which traverses an opening of an article, said system comprising:

a base component comprising at least one mechanism configured to enable said base component to be affixed to said article;

a cap comprising at least one mechanism configured to enable said cap to be secured to said base component;

a rotatable wheel configured to: when rotated in a first direction, spool said cable thereby decreasing an overall length of said cable available to traverse said opening, and, when rotated in a second direction, unspool said cable thereby increasing said overall length of said cable available to traverse said opening, wherein said rotatable wheel is rotated in said first or second direction via rotation of said cap; and one or more electronic components configured to detect at least one parameter associated with a use of said article by a wearer thereof, said one or more electronic components being further configured to monitor a number and direction of rotations applied to said system in order to re-calibrate an orientation of said electronic components prior to said detection of said at least one parameter associated with said use of said article by said wearer.

4. The system of claim 3, wherein:

said rotatable wheel is housed in either said base component or said cap; and said rotatable wheel comprises a circular post around which said cable is wound.

5. The system of claim 3, wherein said one or more electronic components housed in any one of: said base component, said cap, or an interior of said circular post of said rotatable wheel.

6. The system of claim 5, wherein said one or more electronic components are disposed on at least one of a flexible printed circuit board or FR4.

7. The system of claim 3, further comprising a power source housed in any one of: said base component, said cap, or an interior of said circular post of said rotatable wheel and configured to provide power to said electronic components.

8. The system of claim 7, wherein said power source comprises a removable battery which is accessible via removal of said cap from said base component.

9. The system of claim 3, wherein said one or more electronic components comprise at least one of: an accelerometer, a magnetometer, a pressure sensor, an electric field detector, a current detector, a voltage detector, and an RF receiver.

10. The system of claim 3, further comprising a transceiver apparatus configured to at least transmit data relating to said detected at least one parameter associated with said use of said article by said wearer.

11. An electronically-enabled tightening mechanism for use in securing a cable which traverses an opening of an article, said tightening mechanism comprising:

a base component configured to be affixed to said article;

a cap component configured to be secured to said base component;

a rotatable wheel configured to increase and decrease an overall length of said cable available to traverse said opening based on a direction of rotation thereof, said rotation being performed via rotation of said cap manually by a wearer of said article;

one or more electronic components configured to detect and transmit at least one parameter associated with a use of said article by said wearer thereof; and a power source configured to provide power to said one or more electronic components, wherein said one or more electronic components are configured to monitor a number and direction of rotations applied thereto in order to re-calibrate an orientation thereof prior to said detection of said at least one parameter.

12. The tightening mechanism of claim 11, wherein:

said rotatable wheel comprises a circular post around which said cable is wound, and said rotatable wheel is housed in either said base component or said cap;

said one or more electronic components are housed in either of said cap or said interior of said circular post of said rotatable wheel; and said power source is housed in any one of: said base component, said cap, or an interior of said circular post of said rotatable wheel.

13. The tightening mechanism of claim 11, wherein said one or more electronic components are disposed on at least one of a flexible printed circuit board or FR4.

14. The tightening mechanism of claim 11, wherein said power source comprises a removable battery which is accessible via removal of said cap from said base component.

15. The tightening mechanism of claim 11, wherein said one or more electronic components comprise at least one of: an accelerometer, a magnetometer, a pressure sensor, an electric field detector, a current detector, a voltage detector, and an RF receiver.

16. The tightening mechanism of claim 11, wherein said at least one parameter comprises one or more of: speed, acceleration, distance, orientation, force, pressure, and change in direction.

17. The tightening mechanism of claim 1, further comprising a power source disposed substantially within the rotatable reel and configured to provide power to said parameter detector.

18. The tightening mechanism of claim 17, wherein said power source is further configured to cause said parameter detector to enter a sleep mode after a predetermined amount of time in which no parameters are detected.

19. The system of claim 7, wherein said power source is further configured to cause said one or more electronic components to enter a sleep mode after a predetermined amount of time after it is determined that said cable has been unspooled.

20. The tightening mechanism of claim 11, wherein said power source is further configured to cause said one or more electronic components to enter a sleep mode: after a predetermined amount of time in which no parameters are detected, or after a predetermined amount of time after it is determined that said overall length of said cable available to traverse said opening has been increased.

* * * * *